US006772736B2

(12) United States Patent
Liskow

(10) Patent No.: US 6,772,736 B2
(45) Date of Patent: Aug. 10, 2004

(54) FASTENING DEVICE

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/275,053

(22) PCT Filed: Feb. 27, 2002

(86) PCT No.: PCT/DE02/00696

§ 371 (c)(1),
(2), (4) Date: Apr. 16, 2003

(87) PCT Pub. No.: WO02/068815

PCT Pub. Date: Sep. 6, 2002

(65) Prior Publication Data

US 2003/0154961 A1 Aug. 21, 2003

(30) Foreign Application Priority Data

Feb. 28, 2001 (DE) ..... 101 09 408

(51) Int. Cl.[7] ..... F02M 55/02
(52) U.S. Cl. ..... 123/470; 123/509
(58) Field of Search ..... 123/470, 469, 123/468, 509, 495; 239/600

(56) References Cited

U.S. PATENT DOCUMENTS 4,066,213 A * 1/1978 Stampe ..... 239/533.3
4,133,321 A * 1/1979 Hofmann et al. ..... 123/470
4,829,965 A * 5/1989 Gartner et al. ..... 123/470
4,901,700 A * 2/1990 Knight et al. ..... 123/470
5,121,731 A * 6/1992 Jones ..... 123/470
5,706,786 A * 1/1998 Stephanus et al. ..... 123/470
6,116,218 A * 9/2000 Sato et al. ..... 123/470
6,148,799 A * 11/2000 Leipelt et al. ..... 123/469
6,170,467 B1 1/2001 Girard
6,532,939 B2 * 3/2003 Ozeki ..... 123/470

FOREIGN PATENT DOCUMENTS

| | | |
|---|---|---|
| DE | 29 26 490 | 2/1981 |
| EP | 1 001 161 | 5/2000 |
| JP | 8-312503 | 3/1997 |
| WO | WO 99/00595 | 1/1999 |
| WO | WO 00/36295 | 6/2000 |

OTHER PUBLICATIONS

Patent Abstracts of Japan, vol. 1997, No. 03, Mar. 31, 1997.

* cited by examiner

*Primary Examiner*—Carl S. Miller
(74) *Attorney, Agent, or Firm*—Kenyon & Kenyon

(57) ABSTRACT

A mounting device for securing a fuel injector in a cylinder head of an internal combustion engine has at least one hold-down device which is mounted on a front face of the cylinder head and secures fuel injector in a receiving bore of the cylinder head. The at least one hold-down device is supported by a shoulder which is formed at the downstream end of the fuel injector and surrounds the fuel injector at least partially.

24 Claims, 2 Drawing Sheets

FASTENING DEVICE

FIELD OF THE INVENTION

The present invention is directed to a mounting device for securing a fuel injector.

BACKGROUND INFORMATION

A mounting device for mounting a fuel injector on an intake manifold, which axially attaches the fuel injector to the fuel distribution line or to a plug nipple by using a mounting element which is designed as a U-shaped clamp having two legs which are elastic in the radial direction, is described in German Published Patent Application No. 29 26 490. In the assembled state, the clamp reaches through corresponding recesses of the plug nipple and is snappable into a recess in a connection fitting of the fuel injector, the recess being designed as a ring groove. The axial clearance between the recesses and the clamp as well as between the ring groove and the clamp should be kept small, in order to achieve accurate fixation of the fuel injector without stressing the gasket.

The stressing effect of the different mounting parts on the fuel injector is a particular disadvantage of the mounted device described in German Published Patent Application No. 29 26 490. The power flow generated in the fuel injector results in deformations and thus to changes in the lift of the valve needle including jamming, as well as in a compression and bending strain of the housing parts, which are generally thin-walled and welded together at several points. In addition, any fixation measure, e.g., the use of a bearing collar, results in an enlargement of the radial dimension of the fuel injector and thus in an increase in required space for mounting.

SUMMARY

In accordance with the mounting device for a fuel injector according to the present invention, the fuel injector has a collar or shoulder which is mounted on a spray-discharge-side end at which an elastic hold-down device engages, which completely or partially surrounds the end of the fuel injector, whereby the fuel injector is held down in the cylinder head. Thus, axial or bending forces may act only on the valve housing at the downstream end.

The hold-down devices may be easily manufactured by, for example, stamping them out of sheet metal, and they may be suitable for individual fuel injectors, as well as for in-line arrangements of fuel injectors.

The hold-down devices may be fixed in a simple manner to the front face of the cylinder head by using screws or clamping claws.

The hold-down device may be designed as a hold-down pot, which may add greater stability to the fuel injector in the receiving bore of the cylinder head.

The slots and elastic clips formed at the end of the hold-down pot may allow a quick and simple assembly and disassembly of the fuel injector.

Due to shoulders in the hold-down pot, the mounting device is installable in almost any receiving bore of a cylinder head, and may thus be used as an adapter when the bore cross-section is excessively large.

Exemplary embodiments of the present invention are schematically illustrated in the drawings and are explained in greater detail in the following description.

DETAILED DESCRIPTION

Figure 1:
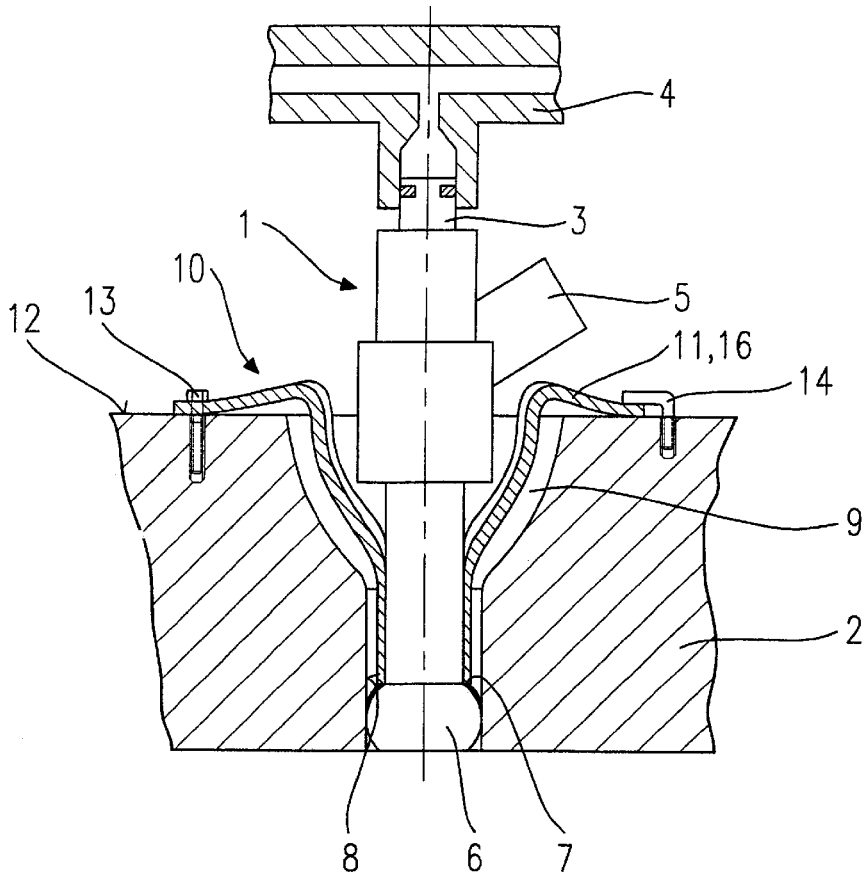
FIG. 1 is a schematic view of a first example embodiment of a mounting device for a fuel injector designed according to the present invention.

FIG. 1 is a schematic partial cross-sectional view through a first example embodiment of a mounting device for a fuel injector designed according to the present invention.

A fuel injector 1 is designed in the form of a direct injecting fuel injector 1 which is installed in a cylinder head 2 for direct injection of fuel into the combustion chamber of, in particular, a mixture-compressing, spark-ignited internal combustion engine. At an inflow-side end 3, fuel injector 1 has a connection to a fuel supply line 4. Fuel injector 1 has a terminal 5 for the electrical contact for the actuation of the fuel injector.

A shoulder 7, which is in contact with a wall 8 of a receiving bore 9 of cylinder head 2, is formed at a downstream end 6 of fuel injector 1. Shoulder 7 may be manufactured by turning, or it may be attached by welding a spherical shape to the downstream end 6 of fuel injector 1, whereby, in addition, good guidance in receiving bore 9 may be achieved.

In order to secure fuel injector 1 in receiving bore 9 of cylinder head 2, a mounting device 10 is provided according to the present invention. Mounting device 10 includes a hold-down device 11, which has a two-part design in the first example embodiment, and rests on downstream end 6 of fuel injector 1. A hold-down device 11 may be stamped out of sheet metal, for example. Hold-down devices 11 are supported by shoulder 7, which is formed at downstream end 6 of fuel injector 1. Hold-down devices 11 may be secured with side parts 16 on front face 12 of cylinder head 2, either, as illustrated in FIG. 1 left, by a screw 13 screwed into cylinder head 2, or, as illustrated in FIG. 1 right, by a clamping claw 14 also attached to front face 12 of cylinder head 2. The clamping claw may be easier to assemble, since a bore in hold-down device 11 is not needed.

The shape of hold-down device 11 may be selected so that a spring action is created by securing side parts 16 to front face 12 of cylinder head 2, and the spring action presses fuel injector 1 into receiving bore 9 in cylinder head 2 via shoulder 7. The axial stability of fuel injector 1 may be achieved not only through the guidance of fuel supply line 4, but also by the fact that hold-down devices 11 partially surround fuel injector 1 in the area of its downstream end 6.

Figure 2A:
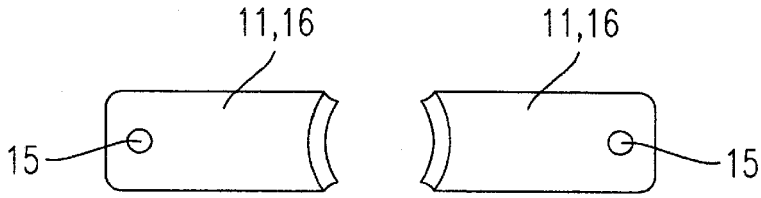
FIGS. 2A and 2B are schematic top views of the mounting device designed according to the present invention.
Figure 2B:
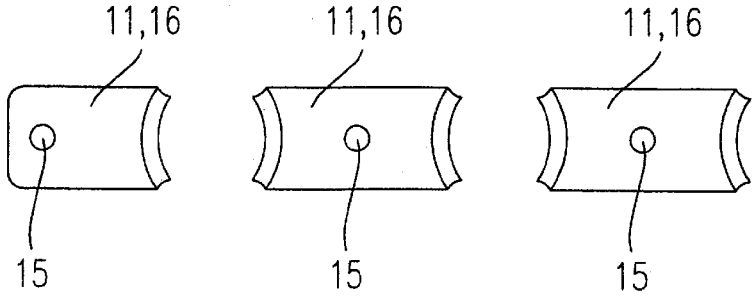

FIGS. 2A and 2B show a schematic top view of two variants of mounting device 10 of fuel injector 1 according to the present invention. Identical components are denoted by identical reference symbols in all figures.

Shown in the Figures, in the flow direction of the fuel, are side parts 16 of hold-down devices 11, which protrude over front face 12 of cylinder head 2. In FIGS. 2A and 2B the hold-down devices are provided with bores 15, for example, for mounting on cylinder head 2.

FIG. 2A shows a symmetrical pair of hold-down devices 11, used for mounting of an individual fuel injector 1, while FIG. 2B shows an exemplary arrangement of several fuel injectors 1 in a line, in which for easier mounting and for further stability each adjacent hold-down device 11 has a one-piece design.

Figure 3:
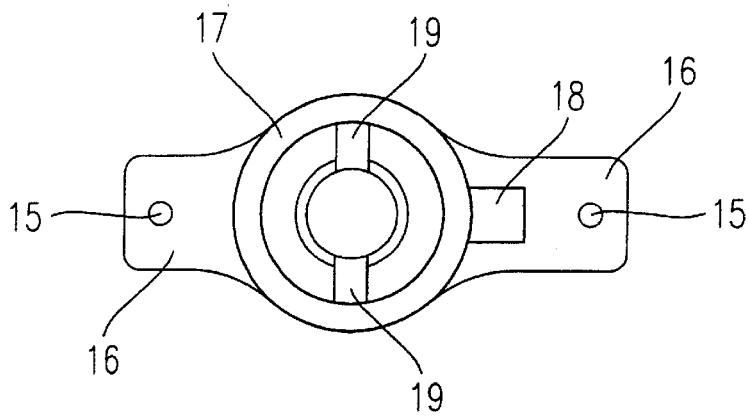
FIG. 3 is a schematic top view of a second example embodiment of a mounting device according to the present invention.

FIG. 3 is a schematic top view of a second example embodiment of a mounting device 10 for a fuel injector 1 designed according to the present invention.

In contrast to the example embodiment of mounting device 10 described in FIG. 1, the second example embodiment described in FIG. 3 has a one-piece, i.e., pot-shape, design. A hold-down pot 17 has in turn two side parts 16 having bores 15 for mounting hold-down pot 17 on front face 12 of cylinder head 2. A recess 18 is used as a feed-through for the electric line for actuating fuel injector 1. Such a hold-down pot 17 may be manufactured by deep-drawing, for example.

In order to insert fuel injector 1 with shoulder 7, formed at its downstream end 6, into hold-down pot 17, at least one slot 19 may be provided (there are two in the present example embodiment), which are symmetrically situated at a downstream end 22 of hold-down pot 17. In order to adapt to the outer shape of fuel injector 1, i.e., receiving bore 9 of cylinder head 2, hold-down pot 17 may have several shoulders 20, as shown in FIG. 4.

Figure 4:
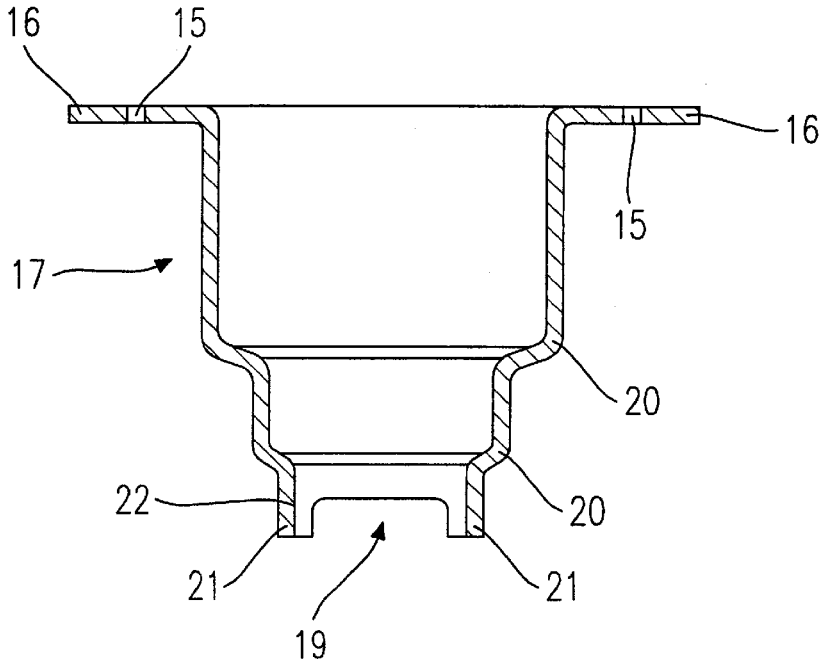
FIG. 4 is a schematic a sectional view of the mounting device illustrated in FIG. 3.
Figure 5:
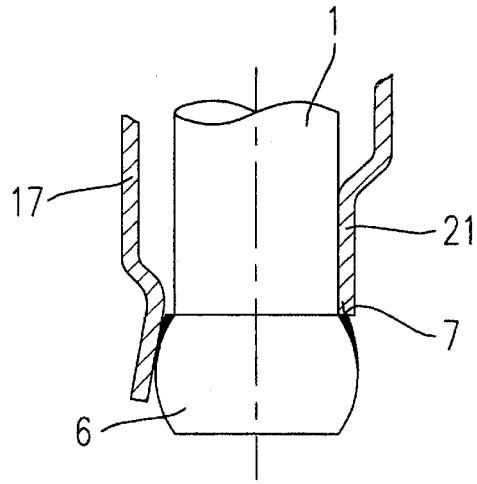
FIG. 5 is a schematic view of the mounting process of a fuel injector using the mounting device illustrated in FIG. 3 and FIG. 4.

FIG. 5 is a schematic view of the mounting process of a fuel injector 1 using mounting device 10 shown in FIGS. 3 and 4.

At least one slot 19 may be provided in a pot-shaped design of mounting device 10 in order to snap end 6 of fuel injector 1, thickened by shoulder 7, into hold-down pot 17. The process used for inserting fuel injector 1 into hold-down pot 17 is schematically illustrated in FIG. 5.

As fuel injector 1 is inserted, clips 21 of hold-down pot 17 situated adjacent to slot 19 initially recede due to the pressure on shoulder 7 situated at downstream end 6 of fuel injector 1. This is shown in the left section of FIG. 5.

If fuel injector 1 is pressed further into hold-down pot 17 against the elastic force of clips 21, then the clips snap back into their original shape at the upstream side of shoulder 7, and come to rest on fuel injector 1. By briefly tightening installed fuel injector 1 it may be achieved that clips 21, supported by shoulder 7, secure fuel injector 1 after assembly of fuel injector 1 and hold-down pot 17 in receiving bore 9 of cylinder head 2. Should fuel injector 1 be disassembled, it may be pulled out of holding-down pot 17, which is facilitated by a spherical shape of shoulder 7.

As in the first example embodiment, holding-down pot 17 may be mounted by using screws 13, which are guided through bores 15, or by using clamping claws.

The present invention is not limited to the illustrated example embodiment and is, for example, also applicable to fuel injectors for injection into the combustion chamber of a self-igniting internal combustion engine.

What is claimed is:

1. A mounting device for securing a fuel injector in a cylinder head of an internal combustion engine, comprising:

at least one hold-down device configured to be secured to one front face of the cylinder head and to fix in position the fuel injector in a receiving bore of the cylinder head; and a shoulder disposed at a downstream end of the fuel injector and at least partially surrounding the fuel injector, the shoulder configured to support the at least one hold-down device;

wherein the at least one hold-down device is configured in to be pre-stressed in its mounted state; and wherein the at least one hold-down device includes two adjacent hold-down devices, configured to mount fuel injectors arranged in a line, having a one-piece design.

2. The mounting device according to claim 1, wherein each hold-down device includes a side part that protrudes over the front face of the cylinder head.

3. The mounting device according to claim 2, wherein the side part of each hold-down device is configured to be secured to the front face of the cylinder head by at least one screw that reaches through at least one bore disposed in the side part.

4. The mounting device according to claim 2, wherein the side part of each hold-down device is configured to be secured to the front face of the cylinder head by at least one clamping claw configured to press the side part to the front face of the cylinder head.

5. The mounting device according to claim 1, wherein each hold-down device includes a holding-down pot having a one-piece design.

6. The mounting device according to claim 5, wherein the holding-down pot includes at least one slot at a downstream end.

7. A mounting device for securing a fuel injector in a cylinder head of an internal combustion engine, comprising:

at least one hold-down device configured to be secured to one front face of the cylinder head and to fix in position the fuel injector in a receiving bore of the cylinder head; and a shoulder disposed at a downstream end of the fuel injector and at least partially surrounding the fuel injector, the shoulder configured to support the at least one hold-down device;

wherein the at least one hold-down device is configured in to be pre-stressed in its mounted state;

wherein the hold-down device includes a holding-down pot having a one-piece design;

wherein the holding-down pot includes at least one slot at a downstream end; and wherein the holding-down pot includes at least one elastically deformable clip disposed at its downstream end.

8. The mounting device according to claim 5, further comprising at least one screw configured to secure the side parts of the holding-down pot to the front face of the cylinder head.

9. The mounting device according to claim 5, further comprising at least one clamping claw configured to secure the side parts of the holding-down pot to the front face of the cylinder head.

10. The mounting device according to claim 7, wherein the at least one hold-down device includes a side part that protrudes over the front face of the cylinder head.

11. The mounting device according to claim 10, wherein the side part of the at least one hold-down device is configured to be secured to the front face of the cylinder head by at least one screw that reaches through at least one bore disposed in the side part.

12. The mounting device according to claim 10, wherein the side part of the at least one hold-down device is configured to be secured to the front face of the cylinder head by at least one clamping claw configured to press the side part to the front face of the cylinder head.

13. The mounting device according to claim 7, further comprising at least one screw configured to secure the side parts of the holding-down pot to the front face of the cylinder head.

14. The mounting device according to claim 7, further comprising at least one clamping claw configured to secure the side parts of the holding-down pot to the front face of the cylinder head.

15. A mounting device for securing a fuel injector in a cylinder head of an internal combustion engine, comprising:

at least one hold-down device configured to be secured to one front face of the cylinder head and to fix in position the fuel injector in a receiving bore of the cylinder head; and a shoulder disposed at a downstream end of the fuel injector and at least partially surrounding the fuel injector, the shoulder configured to support the at least one hold-down device;

wherein the at least one hold-down device is configured in to be pre-stressed in its mounted state; and wherein the downstream end of the fuel injector has at least one of (a) a spherical portion and (b) a convex portion arranged to support the at least one hold-down device.

16. The mounting device according to claim 15, wherein each hold-down device includes a side part that protrudes over the front face of the cylinder head.

17. The mounting device according to claim 16, wherein the side part of each hold-down device is configured to be secured to the front face of the cylinder head by at least one screw that reaches through at least one bore disposed in the side part.

18. The mounting device according to claim 16, wherein the side part of each hold-down device is configured to be secured to the front face of the cylinder head by at least one clamping claw configured to press the side part to the front face of the cylinder head.

19. The mounting device according to claim 15, wherein the at least one hold-down device includes two adjacent hold-down devices, configured to mount fuel injectors arranged in a line, having a one-piece design.

20. The mounting device according to claim 15, wherein each hold-down device includes a holding-down pot having a one-piece design.

21. The mounting device according to claim 20, wherein the holding-down pot includes at least one slot at a downstream end.

22. The mounting device according to claim 15, wherein the holding-down pot includes at least one elastically deformable clip disposed at its downstream end.

23. The mounting device according to claim 20, further comprising at least one screw configured to secure the side parts of the holding-down pot to the front face of the cylinder head.

24. The mounting device according to claim 20, further comprising at least one clamping claw configured to secure the side parts of the holding-down pot to the front face of the cylinder head.

* * * * *